US012258686B1

(12) United States Patent
Geiwald et al.

(10) Patent No.: US 12,258,686 B1
(45) Date of Patent: Mar. 25, 2025

(54) HEATHER SPUN YARNS AND FABRICS, AND METHODS FOR PRODUCING THE SAME

(71) Applicant: Winds Enterprises Limited, Hong Kong (HK)

(72) Inventors: Paul Urban Geiwald, Encinitas, CA (US); Lean Teik Heng, Shanghai (CN); Yu Chung Lo, San Diego, CA (US)

(73) Assignee: Winds Enterprises Limited, Hong Kong (HK)

( * ) Notice: Subject to any disclaimer, the term of this patent is extended or adjusted under 35 U.S.C. 154(b) by 185 days.

(21) Appl. No.: 17/684,706

(22) Filed: Mar. 2, 2022

Related U.S. Application Data

(63) Continuation of application No. 15/965,107, filed on Apr. 27, 2018, now abandoned.
(Continued)

(51) Int. Cl.
*D02G 3/34* (2006.01)
*D02G 3/02* (2006.01)
(Continued)

(52) U.S. Cl.
CPC ..... *D02G 3/346* (2013.01); *D02G 3/02* (2013.01); *D04B 1/126* (2013.01); *D04B 1/16* (2013.01);
(Continued)

(58) Field of Classification Search
CPC . D02G 3/02; D02G 3/04; D02G 3/346; D04B 1/126; D04B 1/16; D04B 21/08; D04B 21/16
See application file for complete search history.

(56) References Cited

U.S. PATENT DOCUMENTS 3,401,142 A 10/1968 Bowman et al.
3,412,547 A 11/1968 Martin
(Continued)

FOREIGN PATENT DOCUMENTS

EP 1 627 942 A1 2/2006
JP 2000-282326 A 10/2000

OTHER PUBLICATIONS

Extended European Search Report issued in EP 14183743.5, dated Jan. 26, 2015, 6 pages.
(Continued)

*Primary Examiner* — Shaun R Hurley
(74) *Attorney, Agent, or Firm* — FROST BROWN TODD LLP

(57) ABSTRACT

A spun heather yarn includes first pre-colored staple fibers comprising first polyester fibers dyed with a first cationic dyestuff, and second pre-colored staple fibers comprising second polyester fibers dyed with a second cationic dyestuff. A knitted heather fabric includes a plurality of the spun heather yarns knitted together to form the knitted heather fabric. The first and/or second pre-colored staple fibers may have contrasting colors. A method of manufacturing a spun heather yarn includes preparing a plurality of first pre-colored staple fibers by dyeing first uncolored staple fibers using a first cationic dyestuff, preparing a plurality of second pre-colored staple fibers by separately dyeing second uncolored staple fibers using a second cationic dyestuff, and spinning the first and second pre-colored staple fibers together to form the spun heather yarn. The spun heather yarns may then be knitted together to form a heather fabric.

20 Claims, 2 Drawing Sheets

Related U.S. Application Data

(60) Provisional application No. 62/491,154, filed on Apr. 27, 2017.

(51) Int. Cl.

| | |
|---|---|
| ***D04B 1/12*** | (2006.01) |
| ***D04B 1/16*** | (2006.01) |
| ***D04B 21/08*** | (2006.01) |
| ***D04B 21/16*** | (2006.01) |
| ***D04B 21/20*** | (2006.01) |
| ***D06P 3/52*** | (2006.01) |
| *A41B 1/08* | (2006.01) |
| *A41D 31/00* | (2019.01) |

(52) U.S. Cl.

CPC ..... *D04B 21/08* (2013.01); *D04B 21/16* (2013.01); *D04B 21/207* (2013.01); *D06P 3/52* (2013.01); *A41B 1/08* (2013.01); *A41D 31/00* (2013.01); *A41D 2500/10* (2013.01); *D10B 2331/04* (2013.01); *D10B 2501/04* (2013.01)

(56) References Cited

U.S. PATENT DOCUMENTS 3,414,957 A * 12/1968 Langstaff ..... D06C 7/02 28/169
3,468,121 A 9/1969 Katsunosuke
3,587,220 A 6/1971 Eggleston
3,593,513 A 7/1971 Reese
3,604,197 A 9/1971 Sekiguchi et al.
3,676,906 A 7/1972 Eggleston
3,681,910 A 8/1972 Reese
3,811,263 A * 5/1974 Newton ..... D02G 1/165 28/258
3,829,543 A 8/1974 Robertson
4,001,171 A 1/1977 Khanna
4,222,223 A 9/1980 Nelson
4,233,363 A * 11/1980 Cemel ..... D02G 1/0286 428/374
4,280,261 A 7/1981 Nelson
4,521,585 A 6/1985 Thomsen et al.
4,602,046 A 7/1986 Buser et al.
5,188,892 A 2/1993 Grindstaff
5,234,645 A 8/1993 Grindstaff
5,308,564 A 5/1994 Grindstaff
5,613,285 A 3/1997 Chester et al.
6,354,067 B2 3/2002 Foil
6,383,635 B1 5/2002 King et al.
6,497,952 B1 12/2002 Ohkoshi et al.
7,070,624 B2 7/2006 Holmes, III et al.
7,818,982 B2 10/2010 Prickett
8,907,009 B2 12/2014 Otto et al.
2009/0173055 A1 7/2009 Silver
2010/0112325 A1* 5/2010 Iwamoto ..... D01F 8/12 428/221
2011/0086225 A1 4/2011 Takagi et al.
2011/0133011 A1* 6/2011 Lee ..... B65H 54/026 264/103
2013/0177264 A1* 7/2013 Utterback ..... D02G 3/04 57/58.54
2015/0068254 A1* 3/2015 Geiwald ..... D01F 1/04 28/165
2015/0107214 A1 4/2015 Rudinger
2015/0122368 A1 5/2015 Poon
2016/0002829 A1 1/2016 Lightman
2018/0179672 A1* 6/2018 Lau ..... D02G 3/04
2018/0179673 A1* 6/2018 Lau ..... D01H 1/02

OTHER PUBLICATIONS

EP Office action dated Nov. 21, 2018, issued in EP 14183743.5, 6 pages.

Unknown, Standard Guide for Heated System Surface Conditions That Produce Contact Burn Injuries, Designation: C 1055-99, Annual Book of ASTM Standards, vol. 04.06, pp. 1-8 (1999).

* cited by examiner

HEATHER SPUN YARNS AND FABRICS, AND METHODS FOR PRODUCING THE SAME

CROSS-REFERENCE TO RELATED APPLICATION(S)

This application is a continuation of U.S. patent application Ser. No. 15/965,107 filed Apr. 27, 2018, which claims priority to and the benefit of U.S. Provisional Application Ser. No. 62/491,154 filed on Apr. 27, 2017 and titled BLEED-FREE POLYESTER SPUN HEATHER YARNS AND FABRICS FOR USE IN THE MANUFACTURE OF ARTICLES OF CLOTHING, AND METHODS FOR PRODUCING THE SAME, the entire content of each of which is incorporated herein by reference.

BACKGROUND

Polyester is used extensively across various industries to make all manner of products, from fabrics for apparel and home furnishings to industrial components such as tire reinforcements, safety belts and conveyor belts. Given the widespread uses of polyester across these industries, manufacturing polyester fabrics in various different colors is extremely important.

A relatively recent trend in the fabric and textile industry is the production of heather fabrics, which have a two-tone color effect in which the same fabric blends two different color tones. In polyester heather fabrics, this two-tone effect is generally limited to combinations or blends of two shades or tones of the same color (e.g., a blend of dark green and light green, or a blend of navy blue and light blue). To achieve this two-tone (same color or hue) effect, first, yarns are produced that contain a blend of two different types of polyester fibers, i.e., cationic dyeable polyester fibers and normal polyester fibers. These blended fiber yarns are then knitted to form the fabric, and the knitted fabric is then dyed in two different dye baths, a process known as "fabric double-dye."

In the fabric double-dye procedure, the knitted fabric is first dyed in a cationic dyestuff, thereby dyeing the cationic dyeable polyester fibers in the knitted fabric. The dyed fabric is then dyed again with a disperse dye to color the normal polyester fibers in the knitted fabric. However, the disperse dye in the second dyeing procedure also colors (or stains) the already dyed cationic dyeable polyester fibers in the fabric. In particular, while cationic dyeable polyester is a polyester that has been modified to create anionic sites suitable for absorbing (or "taking up") cationic dyestuffs, the underlying polyester material maintains certain inherent properties of normal polyester. One of these maintained properties is the absorption (or "taking up") of disperse dyes. As the cationic dyeable polyester fibers in the knitted fabric take up both the cationic dyestuff and the disperse dye during the fabric double-dye procedure, this technique cannot generate heather fabrics with different color hues. Instead, the disperse dye stains the already dyed cationic dyeable polyester fibers, altering the original hue of the cationic dyeable polyester fibers. As such, the fabric double-dye procedure can only produce heather fabrics that blend two tones or shades of the same color.

In addition to the limitations on color combinations, conventionally dyed polyester heather fabrics are generally not suitable or desirable for screen printing. In particular, the disperse dye on the normal polyester fibers is subject to dye sublimation when exposed to high temperatures, such as those encountered during the flashing and curing processes of the screen printing operation. This dye sublimation occurs because the disperse dyestuff has low molecular weight and does not form a strong ionic bond with the normal polyester fibers. As such, when subjected to high temperatures, the disperse dye molecules gain enough energy to detach from the normal polyester fibers and sublime (i.e., transition directly from solid into gas). After this transition, the gaseous disperse dyestuff sublimated from the normal polyester fibers migrates into the printing ink, changing the color of the ink. For example, a red disperse dyestuff that sublimates and migrates into a white printing ink will turn the white printing ink pink. This dye sublimation and migration phenomenon is known as "bleeding," and is considered unacceptable in the textile industry. As "bleeding" nonetheless occurs during screen printing operations, it is common practice to apply an anti-migration layer and a flashing step prior to printing. However, this makes the printed design (or logo) very thick and stiff.

SUMMARY

According to embodiments of the present disclosure, a spun heather yarn includes first pre-colored staple fibers comprising first polyester fibers dyed with a first cationic dyestuff, and second pre-colored staple fibers comprising second polyester fibers dyed with a second cationic dyestuff. The first and second pre-colored staple fibers are spun together to form the spun heather yarn. In some embodiments, the spun heather yarn may further include third pre-colored staple fibers comprising third polyester fibers that are dyed with a third cationic dyestuff. The third pre-colored staple fibers may be spun together with the first and second pre-colored staple fibers to form the spun heather yarn.

In some embodiments, the first pre-colored staple fibers have a color that is contrasting to a color of the second pre-colored staple fibers. In other embodiments, the first pre-colored staple fibers have a color that is a different tone, shade or tint of a color of the second pre-colored staple fibers.

In some embodiments, a knitted heather fabric may include a plurality of the spun heather yarns knitted together to form the knitted heather fabric. The knitted heather fabric may be 100% polyester. In some embodiments, the knitted heather fabric may include a plurality of the spun heather yarns and at least one Spandex yarn knitted together to form the knitted heather fabric.

According to some embodiments, an article of clothing includes the knitted fabric. In the article of clothing, the first pre-colored staple fibers may have a color that is contrasting to a color of the second pre-colored staple fibers. In some embodiments, however, the first pre-colored staple fibers have a color that is a different tone, shade or tint of a color of the second pre-colored staple fibers.

In some embodiments, a method of manufacturing a spun heather yarn includes preparing a plurality of first pre-colored staple fibers by dyeing first uncolored staple fibers using a first cationic dyestuff, preparing a plurality of second pre-colored staple fibers by separately dyeing second uncolored staple fibers using a second cationic dyestuff, and spinning the plurality of first pre-colored staple fibers together with the plurality of second pre-colored staple fibers to form the spun heather yarn. The method may further include separately dyeing a plurality of third pre-colored staple fibers using a third cationic dyestuff, and the spinning may include spinning the first pre-colored staple fibers and the second pre-colored staple fibers with the third pre-colored staple fibers to form the spun heather yarn. In some embodiments, dyeing the plurality of first pre-colored staple fibers and the separately dyeing the plurality of second pre-colored staple fibers each includes combining a plurality of uncolored polyester staple fibers with water to form a fiber bath, adding the first or second cationic dyestuff to the fiber bath to form a dye bath, heating the dye bath to facilitate dyeing, and removing the water from the dye bath to yield the plurality of first pre-colored staple fibers or the plurality of second pre-colored staple fibers.

According to some embodiments, a method of making a knitted heather fabric includes preparing a plurality of the spun heather yarns, and knitting the plurality of spun heather yarns together to form the knitted heather fabric.

BRIEF DESCRIPTION OF THE DRAWINGS

These and other features and advantages of embodiments of the present disclosure will be better understood with reference to the following detailed description when considered in conjunction with the accompanying drawings, in which.

DETAILED DESCRIPTION

Figure 1:
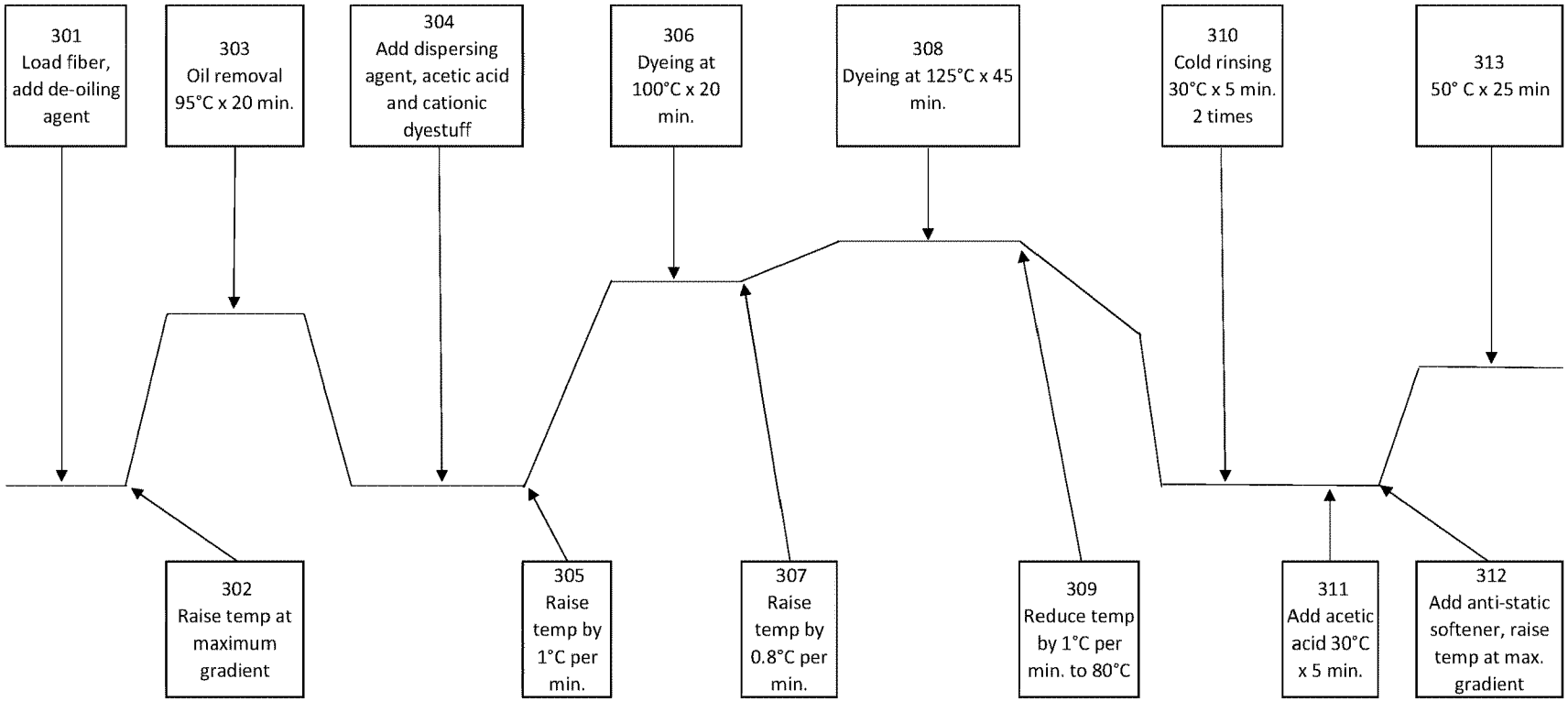
FIG. 1 is a flow chart illustrating a method of dyeing polyester fibers according to embodiments of the present disclosure.

Conventional polyester heather fabrics are manufactured by first knitting together yarns in a knit pattern. To enable the knitted fabric to take on two color tones or shades, the yarns in the fabric are made by blending two different types of polyester fibers, i.e., normal (or unmodified) polyester fibers and cationic dyeable polyester fibers. The knitted fabric is then dyed as a single piece in two different baths of dye solution, a process dubbed "fabric double-dye." The first bath of dye solution typically includes a cationic dyestuff that is absorbed (or "taken up") by the cationic dyeable polyester fibers in the knitted fabric, and the second bath typically includes a disperse dyestuff that is absorbed (or "taken up") by the normal polyester fibers.

As the normal polyester fibers do not absorb (or "take up") the cationic dyestuff, the normal polyester fibers and the cationic dyeable polyester fibers in the knitted fabric can theoretically take on different color tones or shades. However, while the normal polyester fibers do not absorb the cationic dyestuff, the cationic dyeable polyester fibers do absorb (or "take up") the disperse dyestuff. As such, the conventional fabric double-dye technique can only result in heather fabrics having two tones or shades of the same color or hue (e.g., dark green and light green, or navy blue and light blue), and cannot produce heather fabrics with two different hues (e.g., red and green, or red and yellow, or red and blue, or green and yellow, or green and blue, or yellow and blue).

In addition to the limitations on color combinations, the conventional fabric double-dye technique has other drawbacks. First, as this technique dyes the fabric after knitting, each of the dye baths requires a significant amount of water in order to properly saturate the fabric with each dye solution. Second, because the heather fabric is dyed after knitting, heather effects of only two different color tones or shades can be achieved (i.e., the tone or shade of the cationic dyeable polyester fibers, and the tone or shade of the normal polyester fibers).

According to embodiments of the present disclosure, a spun heather yarn (also referred to herein interchangeably as a "spun polyester heather yarn" or a "polyester heather yarn") includes first pre-colored staple fibers comprising first cationic dyeable (or dyed) polyester fibers, and second pre-colored staple fibers comprising second cationic dyeable (or dyed) polyester fibers. Both the first and second cationic dyeable (or dyed) polyester fibers are dyed with a cationic dyestuff. The first and second pre-colored staple fibers are spun together to form the spun heather yarn. In some embodiments, the spun heather yarn may further include third pre-colored staple fibers, which include third cationic dyeable (or dyed) polyester fibers that are also dyed with a cationic dyestuff. The third pre-colored staple fibers are spun together with the first and second pre-colored staple fibers to form the spun heather yarn. It is understood, however, that the spun heather yarns according to embodiments of the present disclosure can include any number of different pre-colored staple fibers. As such, although first, second and third pre-colored staple fibers are mentioned here, any number of more than three different pre-colored staple fibers may be used to create a spun heather yarn including multiple colors (e.g., 2 or more, or 3 or more colors). When the spun heather yarn is made from 3 or more pre-colored staple fibers, the third, fourth, etc. pre-colored staple fibers may also be pre-colored or dyed with a cationic dyestuff.

Indeed, in some embodiments of the present disclosure, a polyester heather yarn and/or fabric (also referred to herein interchangeably as a "spun polyester heather yarn") includes a blend of at least first pre-colored polyester fibers (or staple fibers) and second pre-colored polyester fibers (or staple fibers). In some embodiments, the first and second pre-colored polyester fibers are both dyed with a cationic dyestuff. This blend of polyester fibers dyed using cationic dyestuffs enables the production of polyester heather fabrics that avoid (or reduce) dye sublimation issues common in spun polyester heather products currently on the market.

Additionally, as the polyester fibers are pre-colored (i.e., dyed prior to spinning), the spun polyester heather yarns according to embodiments of the present disclosure can include two or more different hues, basic colors or color families, and not just two different tones, tints or shades of the same basic color or color family. However, again because the polyester staple fibers are pre-colored, the spun polyester heather yarns according to embodiments of the present disclosures can also include two or more different tones, tints or shades of the same basic color or color family. For example, in some embodiments, the spun polyester heather yarn may include first pre-colored staple fibers having a first color, and second pre-colored staple fibers having a second color that is a different color than the first color of the first pre-colored staple fibers. In some embodiments, however, the spun polyester heather yarn may include first pre-colored staple fibers having a first hue, and second pre-colored staple fibers having a second hue that is a different hue than the first hue of the first pre-colored staple fibers. Additionally, in some embodiments, the spun polyester heather yarn may include first pre-colored staple fibers having a first basic color or first color within a first color family, and second pre-colored staple fibers having a second basic color or a second color within a second color family, and the first basic color or first color family may be different from the second basic color or color family.

As used herein, the term "color" is used generically to denote the color, hue, shade, tint or tone of an object (e.g., a stable fiber, yarn or fabric). As such, the term "different color," as used herein to describe the differences between the first and second pre-colored staple fibers (according to certain embodiments of the present disclosure) refers to any difference in color, shade, tone, tint or hue. However, the terms "basic color," "color family" and like terms, are used to denote a primary (or secondary) color, i.e., one of blue, green, red, yellow or green. As an example of the use of these terms, red is a "basic color," while burgundy is a "color" within the red "color family." Additionally, the term "hue" is used herein to denote the dominant "basic color" or "color family" of the "color" being identified. As an example of the use of this term, burgundy and pink are both "colors" having a red "hue" since red is the dominant "basic color" or "color family." Similarly, indigo and sapphire are both "colors" having a blue "hue" since blue is the dominant "basic color" or "color family." Further, as used herein, the terms "tint," "shade," and "tone" refer to lighter or darker versions of the underlying "basic color" or "hue." More specifically, "tint" refers to a lighter version of the underlying "basic color" or "hue" and is typically produced by adding any amount of white color to the underlying "basic color" or "hue." "Tone" also refers to a lighter version of the underlying "basic color" or "hue," but is typically produced by adding any amount of gray color to the underlying "basic color" or "hue." Finally, "shade" refers to a darker version of the underlying "basic color" or "hue," and is typically produced by adding any amount of black color to the underlying "basic color" or "hue."

As an example of this terminology in connection with embodiments of the present disclosure, in an example embodiment in which the spun polyester heather yarn may include first and second pre-colored staple fibers having different first and second colors (respectively), the first "color" may be indigo and the second "color" may be sapphire. As indicated by this example, the first and second pre-colored staple fibers can have first and second "colors" within the same "color family," i.e., the first and second "colors" may be different "shades," "tones" or "tints" of the same "basic color" or "color family" (in this example, the blue "basic color" or "color family").

As a second example of this terminology, in an example embodiment in which the spun polyester heather yarn may include first and second pre-colored staple fibers having different first and second hues (respectively), the first "hue" may be a blue hue and the second "hue" may be a green hue. It is important to note that many "colors" may have a blue (or red, green or yellow) "hue" but also include elements of green (or red, blue or yellow). As such, in this example, while the first "hue" may be blue and the second "hue" may be green, the first and second pre-colored staple fibers may have colors that are similar (though still different), e.g., a first color of cerulean (with a blue dominance or hue) and a second color of teal (with a green dominance or hue).

In another example of this terminology, in an example embodiment in which the spun polyester heather yarn may include first and second pre-colored staple fibers having different first and second "basic colors" or "color families" (respectively), the first "basic color" or "color family" may be blue and the second "basic color" or "color family" may be red. It is important to note that each "color family" may have different shades, tints or tones of the underlying basic color (e.g., different shades, tints or tones of red). However, in this example, the first and second pre-colored staple fibers do not have a slight variation in shade, tone or tint, but rather have different "basic colors" or "color families," (e.g., one red, and one blue). As can be seen from this example, then, the spun heather yarns according to embodiments of the present disclosure can have a contrasting heather effect, i.e., the first and second "basic colors" or "color families" are different, thereby creating a contrast in color, and not just a variation in shade, tone or tint. As further examples of this contrasting effect, if the first pre-colored staple fibers have a red color, the second pre-colored staple fibers may have a yellow, green or blue color, and if the first pre-colored staple fibers have a blue color, the second pre-colored staple fibers can be a red, green or yellow color, etc.

Additionally, conventional polyester heather fabrics require two different types of polyester (i.e., cationic dyeable polyester and normal polyester) to be blended together in order to achieve the heather coloring effect. In particular, because conventional polyester heather fabrics are dyed after knitting into a fabric, they rely on the different dye uptake behaviors of cationic dyeable polyester and normal polyester to achieve the heather effect. As such, conventional polyester fabrics cannot be made with a heather color effect unless both cationic dyeable polyester and normal polyester are included in the fabric. In contrast, according to embodiments of the disclosure, the polyester heather fabric may include only fibers of the same type of polyester, e.g., cationic dyeable polyester. For example, according to embodiments of the present disclosure, a heather fabric or textile can be 100% cationic dyeable polyester while also having a heather coloring effect. Indeed, because the heather fabrics according to embodiments of the present disclosure include pre-colored polyester fibers that are knitted after dyeing, all fibers used in the heather fabric can be the same type of polyester (e.g., cationic dyeable polyester).

Contrary to conventional heather fabrics, the heather fabrics according to embodiments of the present disclosure can also include more than two different colors contributing to the heather effect, and can include contrasting colors. Specifically, because the heather fabrics are knitted from pre-colored polyester fibers, the fabrics can be knitted using any number of differently colored fibers, including, e.g., fibers that have contrasting colors.

As used herein, the term "pre-colored" refers to the coloring or dyeing of the polyester fibers (or staple fibers) before the fibers are knitted or spun into a fabric or textile. Accordingly, the "pre-colored" polyester fibers (or staple fibers) discussed herein are dyed or colored while in the fiber form, and are spun into a heather yarn and then knitted into a textile or fabric after the coloring or dyeing procedure. This enables the production of spun heather yarns and heather fabrics or textiles having more than two colors. Indeed, because the fibers are colored before spinning and knitting, the end yarn and fabric may have any number of different colors contributing to the heather effect, including 3 or more colors.

According to embodiments of the present disclosure, a heather yarn may be formed by blending the first cationic dyeable polyester fibers dyed by a first cationic dyestuff, and second cationic dyeable polyester fibers dyed by a second cationic dyestuff. Similarly, in some embodiments, a heather fabric may be formed by spinning the heather yarns, or by spinning and knitting the first and second polyester fibers (or staple fibers) together. The first and second polyester fibers dyed by a cationic dyestuff may be any desired color, including black and all other colors.

In the heather yarns and/or fabrics according to embodiments of the present disclosure, the cationic dyestuffs used to color the first and second fibers form strong ionic bonds with cationic dyeable polyester materials. These strong ionic bonds create a colorfast textile that is substantially bleed-free even after high temperature exposure. For example, the heather fabrics according to embodiments of the present disclosure achieve grade 4.5 in each of colorfastness to dry heat (American Association of Textile Chemists and Colorists, "AATCC" 117), color fastness to washing (AATCC 61-2A), and color fastness to dye transfer (AATCC 160). The first and second staple fibers also generally do not sublimate under high temperatures, such as those encountered during a screen printing operation (e.g., 300° F. to 340° F.).

In addition, according to embodiments of the present disclosure, heather fabrics can achieve the desired color using significantly less water than conventionally required for currently available heather textiles. In particular, as discussed above, conventional spun heather fabrics are prepared by knitting together yarns made of different fibers (e.g., cationic dyeable polyester fibers and normal polyester fibers) in a knit pattern to form a completed textile or fabric. This knitted fabric is then dyed as a single piece in two different baths of dye solution. Each of these baths of dye solution contains the dye material and other additives, but is mostly water. In significant contrast, according to embodiments of the present disclosure, the first and second staple fibers are dyed prior to spinning the first and second fibers together to form the spun heather yarn, and prior to knitting or weaving the yarns into a fabric or textile. Indeed, the first and second staple fibers (and not the finished textile) are submerged in a dye bath. This saves a significant amount of water compared to the conventional textile dyeing process because the fiber dyeing process according to embodiments of the present disclosure only requires a fiber/liquid ratio of about 1:5.5 to about 1:6.5, or about 1:6. This means that for each 1 kilogram of fibers, only about 5.5 to about 6.5, or about 6 kilograms of liquid (which is mostly water, but also includes the dyestuff, and other chemical agents and/or additives for facilitating dye uptake) is needed to effect sufficient dye uptake and coloring. However, the conventional dyeing method (in which the fabric or textile is submerged in the bath as a single piece) requires a fabric/bath ratio of 1:10 to 1:20. This means that to dye the same weight of fabric (e.g., 1 kilogram), the conventional method requires 10 to 20 kilograms of bath liquid rather than the about 5.5 to about 6.5, or about 6 kilograms used in embodiments of the present disclosure.

As can be seen from this comparison, the dyeing methods according to embodiments of the present disclosure achieve water savings compared to the conventional technique (using an overflow jet dyeing machine) of at least about 35% to about 72.5%, about 45% to about 72.5%, about 35% to about 67.5%, or about 40% to about 60%. In some embodiments, for example, the dyeing methods according to embodiments of the present disclosure achieve water savings compared to the conventional technique of about 35%, about 40%, about 45%, about 60%, about 67.5%, or about 72.5%. However, as discussed further below, because the dyeing methods according to embodiments of the present disclosure separately dye the staple fibers themselves (i.e., prior to spinning and knitting), the staple fibers only need to be dyed once. As such, to produce the same knitted fabric with a heather effect, the conventional process requires two dye baths with a liquid amount based on the total weight of the fabric, while the methods according to the present disclosure require the equivalent of one bath with a liquid amount based on the weight of the fabric (i.e., the weight of the staple fibers). Consequently, while the conventional method requires two baths, each including 10 to 20 kilograms of liquid to dye a 1 kilogram fabric (for a total of 20 to 40 kilograms of liquid dye per kilogram of fabric), the methods according to the present disclosure use only about 2.75 to about 3.75 kilograms of liquid, or about 3 kilograms of liquid, per bath (per type of staple fiber), for a total of about 5.5 to about 7.5 kilograms of liquid total for all staple fibers in embodiments including first and second staple fibers). This represents an even more significant water savings compared to the conventional technique of about 62.5% to about 86.25%, or about 70% to about 85%. In some embodiments, for example, the dyeing methods according to the present disclosure may achieve water savings compared to the conventional methods of about 62.5%, about 70%, about 72.5%, about 81.25%, about 85%, or about 86.25%.

According to embodiments of the present disclosure, a method of making a heather fabric or textile utilizes the water-saving, colorfast benefits of cationic dyeing of staple fibers, and the versatility of a fiber pre-dyeing process. The unique blending of first and second pre-colored polyester fibers dyed by cationic dyestuffs provides a substantially bleed-free fabric or textile that is useful in the production of articles of clothing suitable for screen printing. As used herein, the term "substantially" is used as a term of approximation, and not as a term of degree, and is intended to account for the inherent deviations and variations in measured, observed or calculated properties or values. Accordingly, the term "substantially bleed-free" denotes that the fabric or textile would be considered bleed-free by those of ordinary skill in the art performing a screen printing operation and observing any color bleeding with the naked eye, even if, for example, the screen printed image (e.g., logo) may include some level of color bleeding when measured using a measurement instrument or observed under a microscope.

A method of manufacturing a spun heather yarn according to embodiments of the present disclosure includes preparing a plurality of first pre-colored staple fibers by dying a plurality of first uncolored cationic dyeable polyester staple fibers with a first cationic dyestuff, separately preparing a plurality of second pre-colored staple fibers by dyeing a plurality of second uncolored cationic dyeable polyester staple fibers with a second cationic dyestuff, and spinning the plurality of first pre-colored staple fibers together with the plurality of second pre-colored staple fibers to form the spun heather yarn. The method may further include preparing a plurality of third pre-colored staple fibers by dying a plurality of third uncolored cationic dyeable polyester staple fibers with a third cationic dyestuff. In embodiments with third pre-colored staple fibers, the spinning comprises spinning the first pre-colored staple fibers and the second pre-colored staple fibers with the third pre-colored staple fibers to form a spun heather yarn having three or more colors.

Preparing the plurality of first, second and/or third (or more) pre-colored staple fibers may include separately combining the first, second or third plurality of uncolored staple fibers with water to form a respective fiber bath, adding the first, second or third cationic dyestuff to the respective fiber bath to form a dye bath, heating the dye bath, and removing the water from the dye bath to yield the plurality of first, second and/or third pre-colored staple fibers. In particular, the first, second and/or third staple fibers are each separately dyed via a bath dye process in which uncolored staple fibers are submerged in a bath containing a cationic dyestuff.

Unlike conventional processes for achieving the heather color effect which dyes the fabric after knitting, according to embodiments of the present disclosure, the first, second and/or third (or more) staple fibers are dyed before knitting them together. As such, while the dyeing process for each of the first, second and/or third (or more) staple fibers according to embodiments of the present disclosure relies on a bath dye process using a cationic dye, the staple fibers are dyed in fiber form prior to knitting into a fabric. This process significantly reduces the amount of water needed to dye the resulting textile or fabric, and enables the creation of heather effects with 3 or more colors.

To produce the first, second and/or third (or more) pre-colored polyester staple fibers, raw cationic dyeable polyester staple fibers are dyed in different colors. Then, the first, second and/or third (or more) pre-colored polyester staple fibers are blended to form a mixture of pre-colored staple fibers for achieving the desired tonal, contrasting or multiple color heather effect. The mixture of pre-colored staple fibers are then spun into heather yarns, and the heather yarns are knitted to form a heather fabric. In some embodiments, spandex yarn can be incorporated in the fabric during the knitting process to give the fabric extra elongation and recovery performance. The fabric may then be rinsed and de-oiled to remove contaminants and oil obtained during the yarn spinning and knitting processes. Chemical agents may be added to the fabric during the finishing process to achieve certain desired performance characteristics. Non-limiting examples of suitable such chemical agents include wicking agents, anti-odor agents, ultra-violet protection agents, anti-microbial agents, anti-static agents, soil release agents, water repellent agents, cooling agents, etc.

Any suitable raw cationic dyeable polyester staple fibers may be used to form the first, second and/or third (or more) pre-colored polyester staple fibers. In some embodiments, for example, in order to achieve a color that is rich and dark (e.g., having a CMC L value of 18 or below), the raw cationic dyeable polyester fiber may contain no less than 2.3% of $SO_3^-$ content by weight. The higher the percentage of $SO_3^-$ content in the staple fibers, the more anionic dye sites there are to help attach more cationic dyestuff molecules, thereby achieving a richer and darker color tone. This richness of tone can be important in heather fabrics and textiles, particularly when creating heather effects with contrasting colors, because when fibers of different colors are blended together to create the heather effect, the individual colors become somewhat muted or diluted.

As shown in FIG. 1, to dye the first, second and/or third (or more) staple fibers (also referred to herein as simply "staple fibers"), first bales of raw cationic dyeable polyester staple fibers are unpacked. The loose fibers are then loaded into a dyeing basket of a fiber dyeing machine (301), and weighed to ensure that the weight of the fibers and the weight of the water used to dye the fibers satisfies an appropriate ratio. For example, as discussed above, the weight ratio of the fibers to the water may be about 1:5.5 to about 1:6.5, for example, about 1:6. Water may then be sprayed onto the second staple fibers, and the second staple fibers may be spread loosely and evenly inside the dyeing basket to facilitate optimal dye uptake. The dyeing basket may then be loaded into the fiber dyeing machine.

Once the staple fibers are inside the dyeing machine, water is filled into the machine until it reaches the desired fiber to liquid ratio, e.g., about 1:5.5 to about 1:6.5, for example, or about 1:6. A non-ionic de-oiling agent may then be added to the machine (301) in a ratio of about 2 grams per liter of water. The non-ionic de-oiling agent removes excess oil from the staple fibers which may have been obtained during the fiber extrusion, crimping and/or cutting process. In some embodiments, the de-oiling agent may reduce the amount of oil in the staple fibers to about 0.05 to about 0.1% by weight. Elimination (or reduction) of excess oil helps facilitate dye uptake during the dyeing process.

The dyeing process may begin by increasing the temperature of the bath (i.e., the combination of the staple fibers and the water in the selected weight ratio) from room temperature to a temperature above the glass transition temperature (Tg) of the cationic dyeable polyester material of the staple fibers (302). In some embodiments, the Tg of the cationic dyeable polyester material may be about 70° C. to about 85° C., and the temperature of the bath may be increased to about 95° C. at the maximum gradient achievable by the dyeing machine. As used herein, "increasing the temperature at a maximum gradient" and like descriptions refer to increasing the temperature of the bath to the desired temperature over the shortest time period achievable by the dyeing machine. The machine is then allowed to run for about 20 minutes, to complete the de-oiling process (303).

Then, the water is drained and re-filled to the same weight ratio used in the de-oiling process, e.g., about 1:5.5 to about 1:6.5, or about 1:6. A dispersing agent may then be added as well as the desired cationic dyestuff and a pH adjusting agent (e.g., acetic acid) (304). The dispersing agent may be added to the bath in any suitable amount, for example, about 2 grams per liter. The dispersing agent may be any suitable dispersing agent used in cationic polyester dyeing procedures. Similarly, the cationic dyestuff may be any cationic dyestuff suitable for dyeing cationic polyester staple fibers. Those of ordinary skill in the art would be readily capable of selecting a suitable dispersing agent and cationic dyestuff for this process based on the desired color of the staple fibers. The pH adjusting agent (e.g., acetic acid) is added in order to maintain the pH of the dye bath between about 4.5 and 5.5, in order to facilitate suitable or optimal conditions for dye uptake. The temperature of the machine is then increased at the maximum gradient achievable by the machine (for example at a rate of about 0.7° C. to about 1.3° C. per minute, or about 1° C. per minute) until it reaches 100° C. in order to structurally open the fibers above their glass transition temperature (Tg), thereby exposing the maximum number of dye sites for dye uptake (305). The machine is then run for about 20 minutes (306). Then the temperature of the machine is further increased to about 125° C. at a steady rate of about 0.5° C. per minute to about 1° C. per minute, for example, about 0.8° C. per minute (307). Once the temperature reaches about 125° C., the machine runs for another period of time of about 45 minutes (308). Then the temperature is reduced by about 1.0° C. per minute, until the temperature reduces to a temperature below the Tg of the staple fibers, for example, a temperature of about 80° C. (309). The staple fibers regain their closed structure, thus trapping the dyestuffs inside the fibers. The bath liquid is then drained, and the dyeing process completed.

The machine may then be re-filled with water (to the same ratio as used in the de-oiling and dyeing processes) at a temperature of about 25° C. to about 35° C., for example about 30° C. to being a cool rinsing process. The machine runs for about 3 minutes to about 10 minutes, for example about 5 minutes (310), before the water is drained. This rinsing cycle may be repeated as desired (310).

Then the machine is once again re-filled with water (to the same ratio as used in the de-oiling and dyeing processes) at a temperature of about 25° C. to about 35° C., for example about 30° C., and a pH adjusting agent (e.g., acetic acid) is added to adjust the pH to about 5.5 to about 6.0. The machine may then run for another period of time sufficient to effect pH adjustment, for example about 5 to about 7 minutes, or about 5 minutes (311).

According to some embodiments, the staple fibers may be subjected to an anti-static fiber finishing process. Since dyeing of the staple fibers includes removal of oil to facilitate dye uptake, the resulting dyed fiber has a low oil content. In addition, the dyeing process can cause shrinkage of the fibers, which results in rougher surfaces and higher coefficients of friction. Because polyester fibers are synthetic, a low oil content and high coefficient of friction tend to generate undesirable static during fiber mixing, carding, drawing and spinning processes when the fibers rub against each other or against the metal parts of the machinery. Such high static buildup causes the fibers to stick on the cylinders of the carding machine during the carding process. As a result, slivers are often not formed properly, which makes the subsequent drawing and spinning process difficult if not impossible. To address this problem, according to embodiments of the present disclosure, an anti-static softener may be added to the staple fibers after the dyeing process to achieve a desired mass resistivity of about $8.0\times10^{6}\Omega\cdot m$ to about $4.0\times10^{8}\Omega\cdot m$ and oil content of about 0.12 to 0.25% by weight.

To achieve these parameters, an anti-static softener may be added to the machine after the pH adjustment process. Any suitable anti-static softener may be used, and those of ordinary skill in the art would be readily capable of selecting a suitable anti-static softener. The anti-static softener may be added in any suitable amount, for example about 10 grams per liter. After adding the anti-static softener, the temperature of the machine may be increased to about 50° C. at the maximum gradient achievable by the machine (312), and the machine may then run for another period of time sufficient to achieve the desired mass resistivity and oil content. For example, the machine may run for about 24 to about 26 minutes, or about 25 minutes (313). The liquid is then completely drained.

Conventional heather polyester fabrics available on the market are colored by dyeing greige fabrics after the knitting process using the fabric double-dye process. Specifically, to achieve a two-tone heather effect, the fabric double-dye process requires dyeing of a fabric including two different types of fibers in two different dye baths (because the two different types of fibers "take up" different types of dyestuffs). In this process, the first dye bath includes a cationic dyestuff to color the cationic dyeable fibers in the fabric, and the second dye bath includes a disperse dye to color the normal polyester in the fabric. However, when the fabric is submerged in the second dye bath, the disperse dye not only colors the normal polyester fibers, but also stains the cationic dyeable polyester fibers, as discussed above. As the disperse dye also stains the cationic dyeable polyester fibers, if the color of the normal polyester fibers (dyed by the disperse dye bath) is darker or deeper than the color of the cationic dyeable polyester fibers (from the first dye bath), this staining will alter the shade or tone of the cationic dyeable polyester fibers in the fabric. Accordingly, when using the conventional fabric double-dye process, the different colors achievable on the different fibers of the fabric are limited to those that are similar in color depth. This limitation in color differences prevents the conventional fabric double-dye process from achieving heather color effects in which the different fibers have contrasting colors, e.g., red and blue, or blue and yellow, etc. In contrast, in embodiments of the present disclosure, the first, second and/or third (or more) staple fibers are colored separately, prior to spinning or knitting. As such, there is no limitation on the colors of the different staple fibers in the fabric, and as the different colors are achieved by separately dyeing the fibers, no staining of one fiber with the dye of another fiber occurs.

Additionally, according to embodiments of the present disclosure, the staple fibers themselves are colored prior to the knitting process, yielding significant water savings in the dyeing process, and enabling the manufacture of heather effects with three or more colors. For example, as noted above, the conventional process of dyeing already knitted fabrics or textiles is normally carried out in an overflow jet dyeing machine which requires a liquid ratio of 1:10 to 1:20. This means that every 1 kilogram of fabric requires 10 to 20 kilograms of water for the dyeing process. However, according to embodiments of the present disclosure, the fiber dyeing method requires a drastically reduced amount of water. For example, according to embodiments of the present disclosure, the fiber dyeing method requires a fiber to liquid weight ratio of about 1:5.5 to about 1:6.5, or about 1:6. This means that every 1 kilogram of fibers only requires about 5.5 to about 6.5, or about 6 kilograms of water for the dyeing process. Accordingly, in some embodiments of the present disclosure, the dyeing process uses 27.5% to 55%, or 32.5% to 65%, or 30% to 60% of the water required by the fabric double-dye method to dye the same weight of fabric. This translates to a water savings of 45% to 72.5%, or 35% to 67.5%, or 40% to 70%. As such, according to embodiments of the present disclosure, in addition to being capable of creating heather effects with 2 or more, or 3 or more colors, the fabric dyeing process is also more environmentally friendly.

Additionally, the conventional fabric double-dye procedure requires two different dye baths to dye a single fabric piece to include a heather color effect. As each bath requires a liquid ratio of 1:10 to 1:20, as discussed above, the entire dying procedure requires a liquid ratio of 1:20 to 1:40. In contrast, according to embodiments of the present disclosure, the staple fibers are dyed prior to knitting, and the differently colored fibers are dyed separately. As such, the amount of water needed to color 1 kilogram of fabric according to embodiments of the present disclosure remains 1:5.5 to about 1:6.5, or about 1:6. Therefore, comparing two heather fabrics having the same knitting structure and weight, the amount of water required by a method according to embodiments of the present disclosure in which the fiber/liquid ratio is 1:6 is only about 15% to about 30% of that that required by the conventional method (depending on the liquid ratio used in both processes). This represents a marked water savings of about 70% to about 85%.

According to embodiments of the present disclosure, once the fiber dyeing and finishing processes are completed, the dyeing basket may be taken out of the dyeing machine and loaded into a hydro-extractor. The hydro-extractor rotates at 800 revolutions per minute for around 40 minutes to remove excess water from the fibers. The water content of the fibers may be controlled to between 25 and 30% by weight, so as to avoid excessive loss of the anti-static softener through water extraction, which would affect the anti-static property of the finished fibers. The dyed cationic staple fibers are then taken out of the dyeing basket and placed on a conveyor belt of a steam dryer that runs at about 5 meters per minute at a temperature of 120° C./248° F. The steam dried cationic dyed staple fibers are then loaded into a trolley for color checking and testing of color fastness properties prior to the subsequent yarn formation process.

Figure 2:
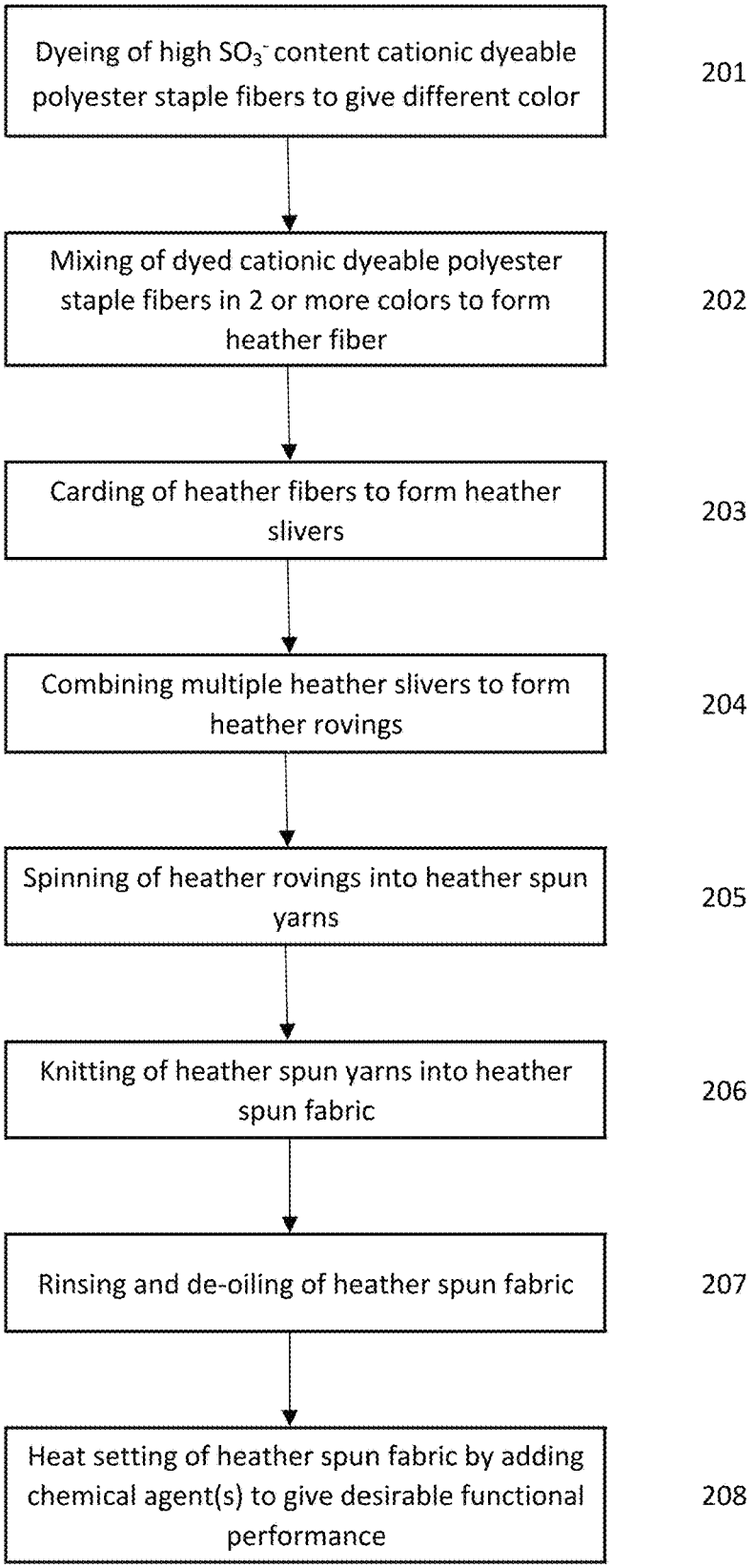
FIG. 2 is a flow chart illustrating a method of making a polyester heather fabric according to embodiments of the present disclosure.

According to some embodiments, when the cationic dyed staple fibers are ready, a heather yarn can be produced. FIG. 2 depicts an example method of making heather spun yarns and fabric. As shown in FIG. 2, the first, second and/or third (or more) dyed staple fibers (201) may go through a fiber opening process. Each color of fiber intended for the heather yarn is opened from a highly compressed bale to give loose fibers. Then, the different fibers are sucked into a fiber mixing machine that mixes the fibers homogeneously according to the desired color recipe (202), i.e., the machine sucks in a specific percentage by weight of each color fiber based on the recipe (202). The mixed fibers may then go through a carding process in which the fibers are mechanically combed to remove contaminants and to align the staple fibers to form loose slivers (203). Multiple slivers are then fed into a sliver mixing machine to form finer rovings (204). The rovings are then fed into a spinning frame where they are drawn and twisted to form heather spun yarns (205). Any suitable spinning technique may be used, non-limiting examples of which include ring spinning, open end spinning, siro spinning, siro compact spinning, etc.

As discussed above, the mass resistivity and oil content of the staple fibers can be controlled by adding an anti-static agent after the dyeing process. In some embodiments, as also discussed above, enough anti-static agent is added to achieve a mass resistivity of about $8.0\times10^{6}\Omega\cdot m$ to about $4.0\times10^{8}\Omega\cdot m$ and an oil content of about 0.12 to 0.25% by weight. If the mass resistivity and oil content are outside these ranges, there is a risk that the stapled fibers will stick to the metal parts of the carding machine, roving frame or spinning frame, which will result in inferior sliver, roving or yarn formation. In particular, the resulting yarn may suffer from inferior uniformity, pilling resistance and strength, and may have increased hairiness.

The heather yarn produced by methods according to embodiments of the present disclosure may include 2 or more colors, or 3 or more colors, which is not achievable by the conventional methods. Indeed, the conventional methods can only produce heather fabrics having at most 2 colors, i.e., the color taken up by the cationic dyeable fibers, and the color taken up by the normal polyester fibers in the disperse dye bath. In contrast, there is theoretically no limit to the number of colors that can be used to create heather yarns according to embodiments of the present disclosure.

The heather yarns according to embodiments of the present disclosure are also substantially bleed-free, i.e., they exhibit little to no bleeding due to the use of staple fibers dyed with cationic dyestuffs, neither of which sublimates under high temperature conditions during normal screen printing processes. Accordingly, the heather yarns according to embodiments of the present disclosure are ideal for making fabrics suitable for screen printing.

In some embodiments of the disclosure, a knitted heather fabric includes a plurality of the spun heather yarns knitted together to form the knitted heather fabric. Because the staple fibers used to form the spun heather yarn are all polyester, the knitted heather fabric may be 100% polyester. Additionally, as all the staple fibers used to form the spun heather yarn can be cationic dyeable polyester staple fibers, the knitted heather fabric may be 100% cationic dyeable polyester, a fabric and heather color effect combination that is not achievable using the conventional heather dyeing process. In some embodiments, however, the spun heather yarns disclosed herein can be combined with other materials (e.g., Spandex) to form the knitted heather fabric. According to some embodiments, to create a heather effect with more than two colors, a knitted heather fabric may include a plurality of the spun heather yarns having first, second and/or third (or more) pre-colored staple fibers knitted together to form the knitted heather fabric, or may include a plurality of such yarns in addition to Spandex yarns knitted together to form the knitted heather fabric.

Referring back to FIG. 2, to produce knitted fabrics (206) of a desired construction, the heather yarns may be fed into either a weft or warp knit machine in the form of bobbin or warp beams for knitting. Spandex yarns can also be incorporated into the fabric during the knitting process to give the knitted fabric higher elongation and good recovery properties. Once the knitting is finished, the fabric may go through a rinsing process (207) to remove contaminants and oil that may have been obtained during the spinning and knitting processes. After this rinsing, the fabric may be heat set to stabilize its dimensions and physical properties (208). During the heat setting process, additional chemical agents can be padded onto the fabric to achieve a desired function or performance characteristic. Non-limiting examples of such chemical agents include wicking agents, soil release agents, anti-static agents, anti-odor agents, anti-microbial agents, ultra-violet protection agents, cooling agents, water repellant agents, etc. to achieve specific desirable functional performance.

After the heat setting process, the knitted fabric is completed. Since cationic dyestuffs form strong ionic bonds with the dyeable cationic polyester materials of the staple fibers, the finished fabric has superb colorfastness. For example, in some embodiments, color fastness to dry heat (AATCC 117), color fastness to washing (AATCC 61-2A) and color fastness to dye transfer (AATCC 160) of the fabrics all achieve a grade of 4.5 or above.

According to some embodiments, the heather knitted fabric may be used to make articles of clothing or apparel. Those of ordinary skill in the art would be readily capable of using the heather fabrics disclosed herein to make articles of clothing or apparel. In some embodiments, when the heather fabrics disclosed herein are made into articles of clothing or apparel that require screen printing (such as, for example, a tee shirt), the shirt will go through printing, flashing & curing (common steps in screen printing an article of clothing). First, the shirt may be put onto a printing board where it may be affixed and screen printed either by a hand squeegee or an automatic squeegee. Once the article is printed with a plastisol ink, the shirt is placed under a flash dryer (i.e., a high wattage output infrared device that helps to quickly solidify the ink within seconds with high heat). The temperature needed to cure most plastisol inks on polyester articles of clothing (e.g., polyester tee shirts) is usually around 300° F. to 320° F., and the article of clothing is typically exposed to that heat for about 5 to a maximum of 10 seconds. If the print design has two colors, the tee may need to be printed and flashed a second time. If the print design has more than two colors, the tee may need to be printed and flashed an additional time for each additional color (e.g., a three-color print design may need three printing and flashing procedures, etc.). After the last flash, the shirt is removed from the printing board and placed on a conveyor belt of an infrared curing machine with the printed side facing upward. The shirt will then go through an enclosed infrared heating chamber for around 1 minute to completely cure the plastisol ink on the fabric. The temperature of the infrared heating chamber is typically set between 320° F. to a maximum of 340° F. for polyester articles of clothing or apparel (e.g., tee shirts).

Since the fabrics according to embodiments of the present disclosure include cationic dyeable polyester staple fibers dyed with cationic dyestuffs, the strong ionic bond formed between the cationic dyestuff molecules and the staple fibers generally do not break up when exposed to the flashing and curing temperatures experienced during screen printing. Thus, little to no dye migration occurs during screen printing. As a result, according to embodiments of the present disclosure, the heather fabric can achieve a grade of 4.5 on the color fastness to dry heat test (AATCC 117). Accordingly, the heather fabrics according to embodiments of the present disclosure are "bleed-free." As used herein, the term "bleed-free" refers to the color fastness of the heather fabrics achieving a grade of 4.5 or better on the color fastness to dry heat test (AATCC 117). In contrast, in articles of clothing (e.g., tee shirts) made with heather fabrics currently available on the market (e.g., those made by combining cationic dyeable polyester fibers and normal polyester fibers, and dyed after knitting), the disperse dyestuffs sublimate during the flashing and curing procedures of the screen printing process. As such, those conventional fabrics are undesirable for screen printing.

In sum, as shown in FIGS. 1 and 2, a process of making a heather spun polyester yarn according to embodiments of the present disclosure includes dyeing high $SO_3^-$ content cationic dyeable polyester staple fibers with cationic dyestuffs using a fiber bath dye method to make first, second and/or third (or more) pre-colored stable fibers (201). The first and second (and/or third or more) staple fibers are then mixed at a specific weight percentage to create heather fibers of two or more colors (202). The heather fibers are then carded to form heather slivers (203), and multiple heather slivers are combined to form heather rovings (204). The heather rovings are then spun to form spun heather yarn (205), and the spun heather yarn is knitted to form a spun heather fabric (206). The spun heather fabric may then be rinsed and de-oiled (207), and then heat set using chemical agents to complete the finished heather fabric (208). The completed heather fabric can then be formed into an article of clothing, and screen printed (if desired).

While certain exemplary embodiments of the present disclosure have been illustrated and described, those of ordinary skill in the art will recognize that various changes and modifications can be made to the described embodiments without departing from the spirit and scope of the present disclosure, and equivalents thereof, as defined in the claims that follow this description. For example, although certain components may have been described in the singular, i.e., "a" chemical agent, and the like, one or more of these components in any combination can be used according to the present disclosure.

Also, although certain embodiments have been described as "comprising" or "including" the specified components, embodiments "consisting essentially of" or "consisting of" the listed components are also within the scope of this disclosure. For example, while embodiments of the present disclosure are described as including a combination of first and second pre-colored staple fibers, a spun polyester yarn consisting essentially of or consisting of first and second pre-colored staple fibers is also within the scope of this disclosure. Accordingly, the spun polyester yarn may consist essentially of the first and second pre-colored staple fibers. In this context, "consisting essentially of" means that any additional components in the spun polyester yarn will not materially affect the ability of the ability of the staple fibers to be spun into the yarn, or the ability of the yarn to be knitted into a fabric or textile.

As used herein, unless otherwise expressly specified, all numbers such as those expressing values, ranges, amounts or percentages may be read as if prefaced by the word "about," even if the term does not expressly appear. Further, the word "about" is used as a term of approximation, and not as a term of degree, and reflects the penumbra of variation associated with measurement, significant figures, and interchangeability, all as understood by a person having ordinary skill in the art to which this disclosure pertains. Any numerical range recited herein is intended to include all sub-ranges subsumed therein. Plural encompasses singular and vice versa. For example, while the present disclosure describes "a" chemical agent, a mixture of such chemical agents can be used. When ranges are given, any endpoints of those ranges and/or numbers within those ranges can be combined within the scope of the present disclosure. The terms "including" and like terms mean "including but not limited to," unless specified to the contrary.

Notwithstanding that the numerical ranges and parameters set forth herein may be approximations, any numerical value inherently contains certain errors necessarily resulting from the standard variation found in their respective testing measurements. The word "comprising" and variations thereof as used in this description and in the claims do not limit the disclosure to exclude any variants or additions.

What is claimed is:

1. A substantially bleed-free spun heather yarn, comprising:

first pre-colored staple fibers comprising first polyester fibers dyed with a first cationic dyestuff, the first polyester fibers having at least 2.3% $SO_3^-$ content by weight and having a first color, and second pre-colored staple fibers comprising second polyester fibers dyed with a second cationic dyestuff, the second polyester fibers having at least 2.3% $SO_3^-$ content by weight and having a second color different from the first color, the first and second pre-colored staple fibers being spun together to form the spun heather yarn, and the spun heather yarn achieves grade 4.5 or better in one or more of color fastness to dry heat, color fastness to washing, and color fastness to dye transfer.

2. The substantially bleed-free spun heather yarn of claim 1, further comprising third pre-colored staple fibers comprising third polyester fibers that are dyed with a third cationic dyestuff, the third polyester fibers having at least 2.3% $SO_3^-$ content by weight and having a third color different from both the first color and the second color, wherein the third pre-colored staple fibers are spun together with the first and second pre-colored staple fibers to form the spun heather yarn.

3. A substantially bleed-free knitted heather fabric comprising a plurality of the spun heather yarns according to claim 1 knitted together to form the knitted heather fabric, the knitted heather fabric achieving grade 4.5 or better in one or more of color fastness to dry heat, color fastness to washing, and color fastness to dye transfer.

4. The substantially bleed-free knitted heather fabric of claim 3, wherein the knitted heather fabric is 100% polyester.

5. A substantially bleed-free knitted heather fabric comprising a plurality of the spun heather yarns according to claim 2 knitted together to form the knitted heather fabric, the knitted heather fabric achieving grade 4.5 or better in one or more of color fastness to dry heat, color fastness to washing, and color fastness to dye transfer.

6. A substantially bleed-free knitted heather fabric comprising a plurality of the spun heather yarns according to claim 1 and at least one Spandex yarn knitted together to form the knitted heather fabric, the knitted heather fabric achieving grade 4.5 or better in one or more of color fastness to dry heat, color fastness to washing, and color fastness to dye transfer.

7. A substantially bleed-free knitted heather fabric comprising a plurality of the spun heather yarns according to claim 2 and at least one Spandex yarn knitted together to form the knitted heather fabric, the knitted heather fabric achieving grade 4.5 or better in one or more of color fastness to dry heat, color fastness to washing, and color fastness to dye transfer.

8. The substantially bleed-free spun heather yarn according to claim 1, wherein the first color of the first pre-colored staple fibers is contrasting to the second color of the second pre-colored staple fibers.

9. The substantially bleed-free spun heather yarn according to claim 1, wherein the first color of the first pre-colored staple fibers is a different tone, shade or tint of the second color of the second pre-colored staple fibers.

10. An article of clothing, comprising the substantially bleed-free knitted heather fabric of claim 3.

11. The article of clothing according to claim 10, wherein the first color of the first pre-colored staple fibers is contrasting to the second color of the second pre-colored staple fibers.

12. The article of clothing according to claim 10, wherein the first color of the first pre-colored staple fibers is a different tone, shade or tint of the second color of the second pre-colored staple fibers.

13. An article of clothing, comprising the substantially bleed-free knitted heather fabric of claim 5.

14. A method of manufacturing the substantially bleed-free spun heather yarn of claim 1, the method comprising:

preparing a plurality of the first pre-colored staple fibers by dyeing first uncolored staple fibers using the first cationic dyestuff having the first color;

preparing a plurality of the second pre-colored staple fibers by dyeing second uncolored staple fibers using the second cationic dyestuff having the second color; and spinning the plurality of first pre-colored staple fibers together with the plurality of second pre-colored staple fibers to form the substantially bleed-free spun heather yarn.

15. The method according to claim 14, further comprising:

separately dyeing a plurality of third pre-colored staple fibers using a third cationic dyestuff having a third color that is different from both the first and second colors, wherein the spinning comprises spinning the first pre-colored staple fibers and the second pre-colored staple fibers with the third pre-colored staple fibers.

16. The method according to claim 14, wherein the dyeing the plurality of first pre-colored staple fibers and the dyeing the plurality of second pre-colored staple fibers each comprises:

combining a plurality of the first or second uncolored polyester staple fibers with water to form a fiber bath;

adding the first or second cationic dyestuff to the fiber bath to form a dye bath;

heating the dye bath to facilitate dyeing; and removing the water from the dye bath to yield the plurality of first pre-colored staple fibers or the plurality of second pre-colored staple fibers.

17. The method according to claim 14, wherein the first color of the first pre-colored staple fibers is contrasting to the second color of the second pre-colored staple fibers.

18. The method according to claim 14, wherein the first color of the first pre-colored staple fibers is a different tone, shade or tint of the second color of the second pre-colored staple fibers.

19. A method of making a knitted heather fabric, the method comprising:

preparing a plurality of spun heather yarns according to the method of claim 14; and knitting the plurality of spun heather yarns together to form the knitted heather fabric.

20. A method of making a knitted heather fabric, the method comprising:

preparing a plurality of spun heather yarns according to the method of claim 15; and knitting the plurality of spun heather yarns together to form the knitted heather fabric.

* * * * *